US005326094A

United States Patent [19]

Quinn

[11] Patent Number: 5,326,094

[45] Date of Patent: Jul. 5, 1994

[54] AUDIO SPORTS GAME

[76] Inventor: Timothy G. Quinn, 1255 Chimney Ridge, Traverse City, Mich. 49684

[21] Appl. No.: 19,761

[22] Filed: Feb. 19, 1993

[51] Int. Cl.[5] ..... A63B 63/08

[52] U.S. Cl. ..... 273/1.5 R; 273/57.2; 273/371; 273/55 D

[58] Field of Search ..... 273/1.5 R, 1.5 A, 57.2, 273/371, 55 D

[56] References Cited

U.S. PATENT DOCUMENTS

| | | | |
|---|---|---|---|
| 3,244,420 | 4/1966 | Poynter | 273/1.5 R X |
| 3,575,559 | 4/1971 | Tierney | 273/371 X |
| 4,480,833 | 11/1984 | Barcelow et al. | 273/85 B |
| 4,607,842 | 8/1986 | Daoust | 273/57.2 |
| 4,861,034 | 8/1989 | Lee | 273/DIG. 30 X |
| 4,904,981 | 2/1990 | Mele et al. | 273/1.5 R X |
| 4,934,937 | 6/1990 | Judd | 273/371 X |
| 4,999,603 | 3/1991 | Mele et al. | 273/1.5 R X |
| 5,064,195 | 11/1991 | McMahan et al. | 273/1.5 R |
| 5,124,899 | 6/1992 | Hale | 273/1.5 R X |
| 5,133,546 | 7/1992 | Matherne et al. | 273/1.5 A |
| 5,163,680 | 11/1992 | Amron | 273/1.5 A |
| 5,230,512 | 7/1993 | Tattershall | 273/DIG. 30 X |

*Primary Examiner*—Paul E. Shapiro

*Attorney, Agent, or Firm*—Harness, Dickey & Pierce

[57] ABSTRACT

An audio sports game is provided. This sports game utilizes an audio message generator that selectively generates one of a plurality of audio messages. When the message generator is actuated by a switch, it generates a message that presents a setting for a user of said sports game. This message is generated prior to and during said user attempting to cause an object to pass through said opening in a structure such as a sports goal.

18 Claims, 3 Drawing Sheets

AUDIO SPORTS GAME

BACKGROUND AND SUMMARY

This invention generally relates to a sports game and, more particularly, to a sports game that utilizes audio messages to present a fictional setting for the person playing the game.

The tremendous popularity of sports activities has generated much interest not only in official sporting equipment, but also in novelty sporting equipment for both children and adults. Consequently, a number of novelty goals, particularly basketball rims, have been introduced to the public as toys for children and novelty items for adults. Such products include novelty basketball rims that affix to walls, doors, trash cans and the like, and further include toy basketball goals having a rim and backboard on an adjustable pole for use by small children. Many of these products include fairly sophisticated electronic gadgetry that provides for automatic scoring, electronic timing, and even audio feedback to the user when a basket is made as disclosed in U.S. Pat. No. 5,064,195 issued to McMahan et al on Nov. 12, 1991.

While these devices do provide great recreation, one feature they do not offer is providing a setting for the user of the game by audio messages. In other words, it is every sports enthusiast's dream to be in a setting where it's the big game with only a few seconds left and to be taking the last shot to win it all. Accordingly, the present invention provides a portable device, adaptable to any number of sports goals, that creates such a setting by generating a number of audio messages prior to and during the user's attempt to score a goal.

One example of such a setting would be an audio message by a well known sports commentator stating that it was the seventh game of a best of seven series in the NBA Championship Finals. The commentator would then indicate that there were ten seconds left in the game, the score was tied, and the ball was being inbounded to the user of the game. The audio message would also provide background crowd noise along with a countdown of the time remaining by the crowd. Thus, the user would be placed in a setting where it was necessary for the user to score a goal before the time remaining on the game clock expired. In addition, audio messages could be programmed to provide feedback that is dependent upon either a basket being made or the lapse of time remaining on the game clock.

Additional objects, advantages, and features of the present invention will become apparent from the following description and appended claims, taken in conjunction with the accompanying drawings.

DETAILED DESCRIPTION OF THE PREFERRED EMBODIMENT

Figure 1:
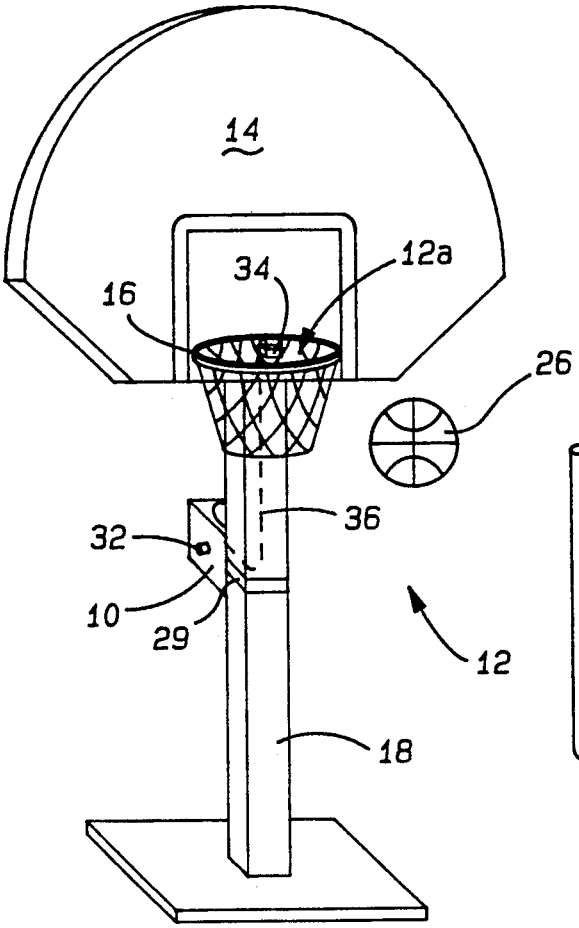
FIG. 1 is a perspective view of a basketball goal diagrammatically illustrating a device for generating audio messages in accordance with the principals of the present invention.
Figure 2:
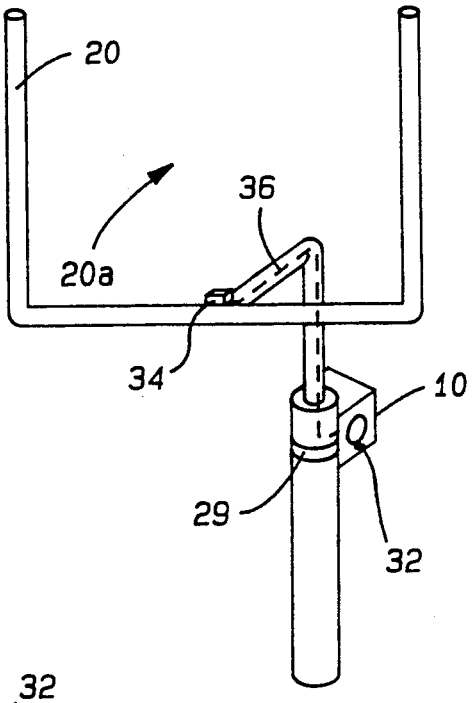
FIG. 2 is a perspective view of a football goal diagrammatically illustrating a device for generating audio messages in accordance with the principals of the present invention.
Figure 3:
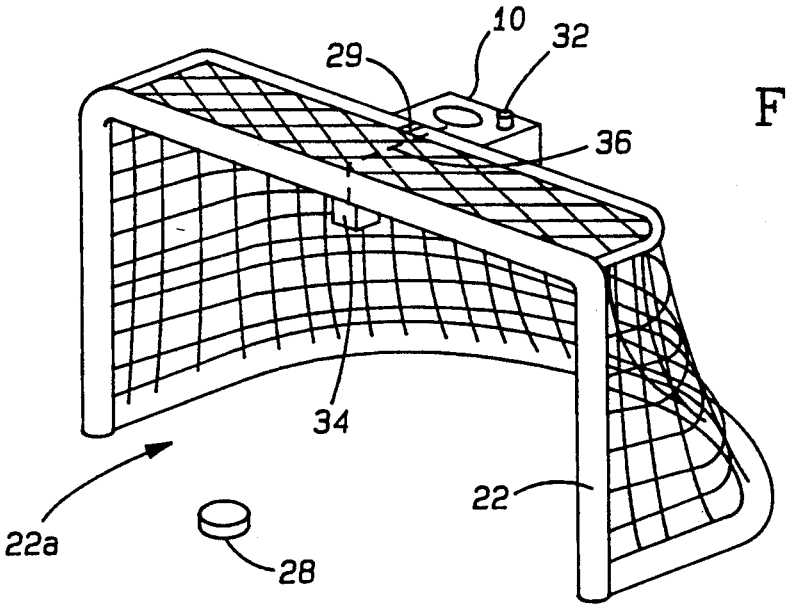
FIG. 3 is a perspective view of a hockey goal diagrammatically illustrating a device for generating audio messages in accordance with the principals of the present invention.
Figure 4:
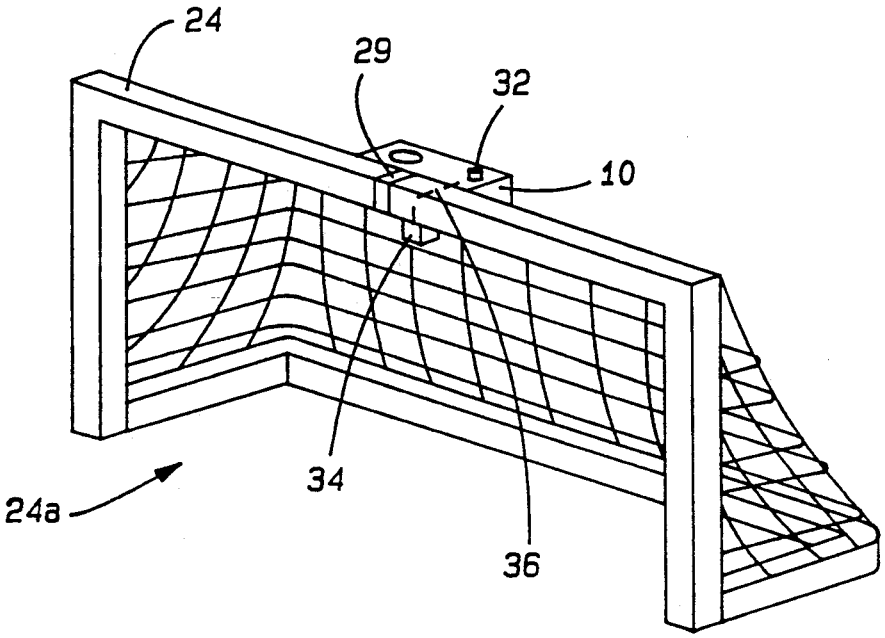
FIG. 4 is a perspective view of a soccer goal diagrammatically illustrating a device for generating audio messages in accordance with the principals of the present invention.
Figure 5:
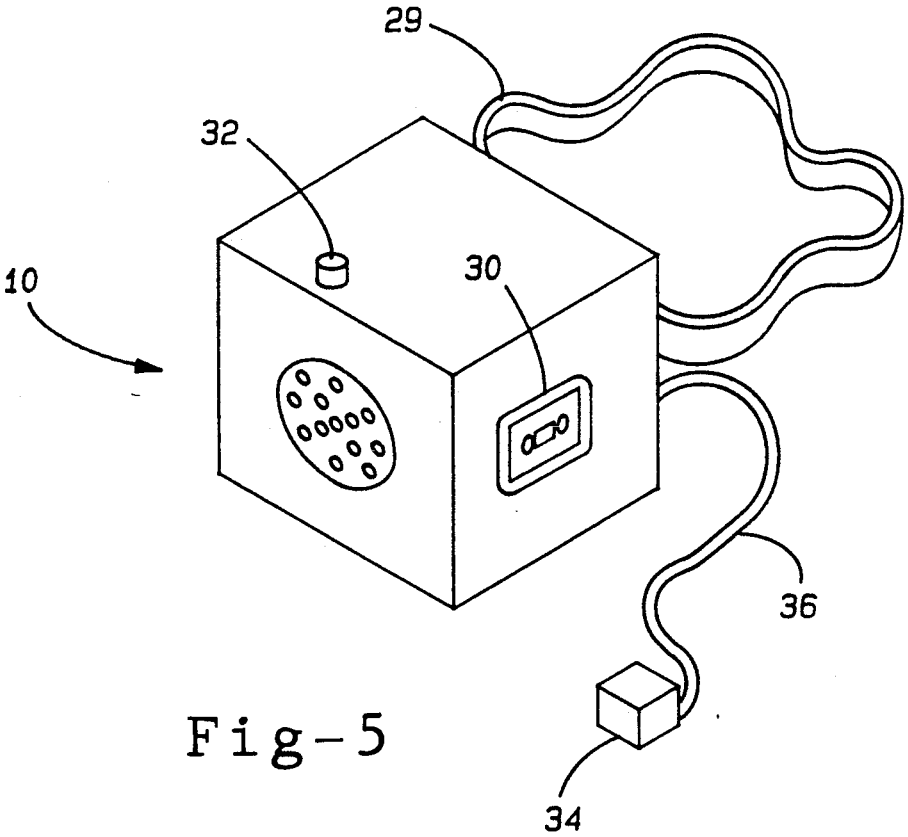
FIG. 5 is a diagrammatic illustration of the portable audio message generator of the present invention, depicting the device being coupled to a sensor that senses if an object has passed through a goal.
Figure 6:
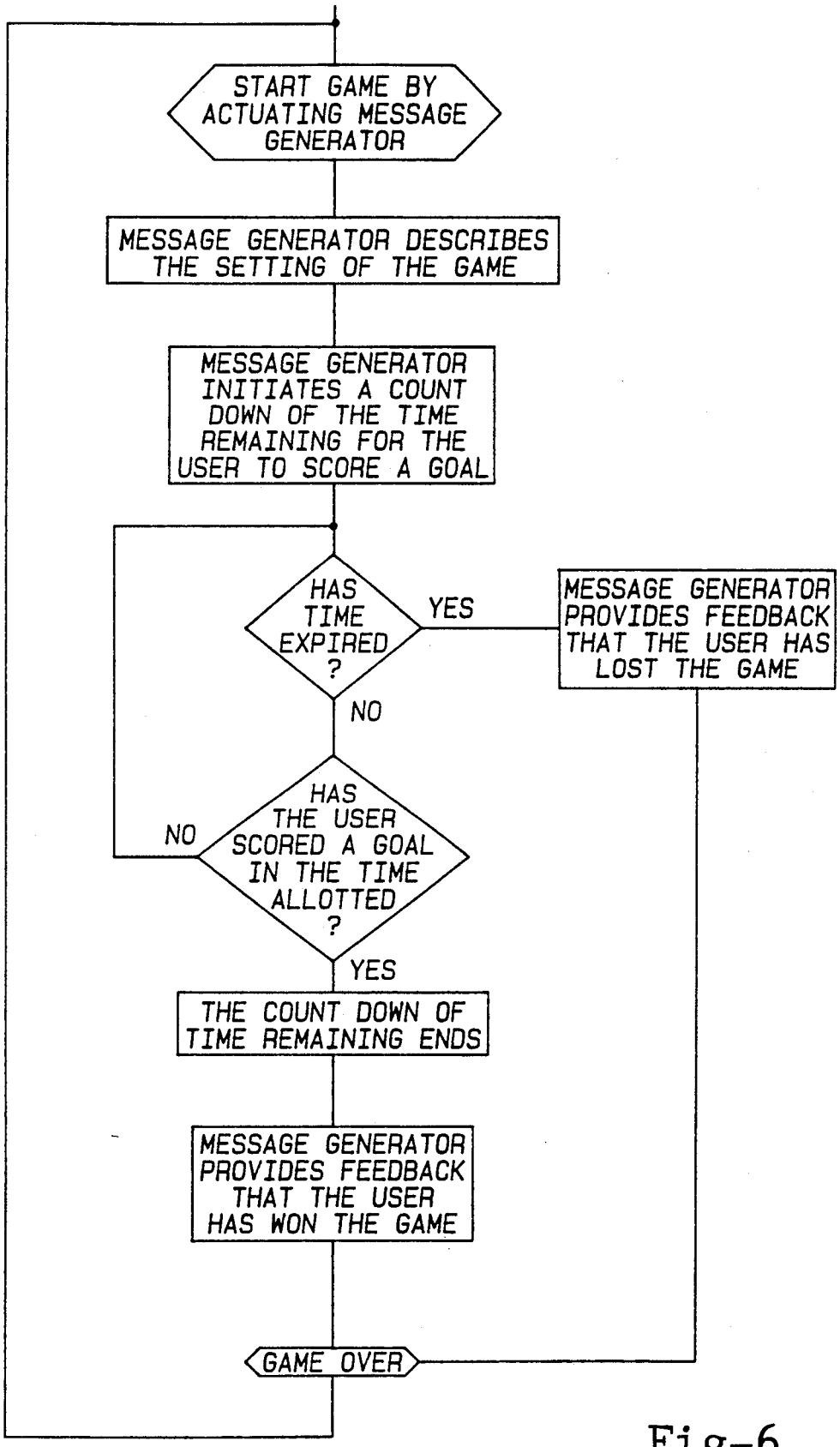
FIG. 6 is a flow chart illustrating the logic utilized by one embodiment of the audio message generator of the present invention.

Referring now to the drawings, and in particular, FIG. 1, one embodiment of the audio sports game of the present invention is shown. In this particular embodiment, a portable audio message generator 10 is affixed to a basketball goal 12 which includes a backboard 14, a rim 16 and a post 18 for supporting the backboard 14 and rim 16. Although the embodiment depicted in FIG. 1 is preferred, the sports goals shown in FIGS. 2 through 4 are additional embodiments that also employ audio message generators 10 in accordance with the principles of the present invention. FIG. 2 illustrates a football goal 20; FIG. 3 illustrates a hockey goal 22; and FIG. 4 illustrates a soccer goal 24.

Each of the goals 12, 20, 22 and 24 shown in FIGS. 1 through 4 provides structure that defines an opening 12A, 20A, 22A and 24A such that an object can pass therethrough. Generally, the object used is a basketball 26, a puck 28 or the like, however, other objects small enough to pass through the respective goal openings 12A, 20A, 22A and 24A can be substituted. Note that the goals 12, 20, 22 and 24 illustrated in FIGS. 1 through 4 represent both official goals utilized by athletes in the sport itself, and novelty goals used primarily by children and sports enthusiasts.

Each of these goals 12, 20, 22 and 24 has an audio message generator 10 that preferably attaches to the goal apparatus as shown in FIGS. 1 through 4. To accommodate this attachment, the message generator 10 preferably utilizes a conventional velcro attaching strap 29 such that it can be readily attached, by either a user or a manufacturer, to both official goals and novelty goals. Alternatively, this message generator 10 can be positioned at a remote location (not shown), away from the goal apparatus. As a result, most any goal is readily converted into a goal that can be used in accordance with the principals of the present invention. Although a velcro attaching strap is preferred, one of ordinary skill in the art would certainly recognize that any number of conventional attaching mechanisms could also be utilized.

Whether the message generator 10 is directly affixed to a goal 12, 20, 22 or 24, or remotely located, it utilizes a compact disk player, conventional cassette tape player, or the like 30, to play prerecorded messages. The message generator 10 further includes conventional electronic circuitry (not shown) that controls when the messages are played and the types of messages played. Part of this electronic circuitry is a conventional switch 32 that, when actuated by a user, causes the message generator 10 to begin playing a message. Preferably, this message presents a setting for a fictional sporting event where only a limited amount of time remains, during which the user must score a goal in order to win.

In order to determine whether or not the user has in fact scored a goal during this time period, a sensor 34 can be attached to the goal apparatus 12, 20, 22 or 24. This sensor 34 monitors the goal 12, 20, 22 or 24 to detect if an object has passed through the goal opening 12A, 20A, 22A or 24A. If the user does score a goal, that information is communicated to the message generator 10 by a signal sent through either a transmission line or by wave transmission as diagrammatically shown at 36. This signal will cause the message generator 10 to stop the message and play a second message indicating that the user has won the sporting event described. If, on the other hand, the user does not score a goal in the time allotted, the message continues to play. However, this portion of the message describes that the user has lost the sporting event previously described.

Preferably, a number of prerecorded, general audio messages are created on cassette tapes, compact disks, or the like such that the messages can be selectively played. By utilizing a general message, that does not refer to the user by name, any user can play the game. Alternatively, these general messages can be recorded such that a specific person's name is included as part of the audio message. Thus, the audio messages can provide a fictional setting that includes a personal reference to the user of the sports goal. In any event, the electronic circuitry (not shown) of the message generator 10 has means for selecting any number of messages, each of which describe different settings for various fictional sporting events.

In operation, a user simply attaches the message generator 10 to a goal 12, 20, 22 or 24 and orients the sensor 34 on the goal to monitor the goal opening 12A, 20A, 22A or 24A. The user then selects a message by actuating the switch 32, triggering the message generator 10 to play the prerecorded message selected by the user. This message creates a setting for the "last shot" of a fictional sporting event by having a sports commentator describe the setting as if it were being broadcast over radio or television. The setting may include a number of descriptions such as the names of the teams playing, names of the players on those teams, a brief summary of the game, the significance of the game being played, the score, the amount of time remaining, the specific situation at hand and the like. After the initial setting is given, the commentator preferably begins his play by play analysis with a description of a common occurrence that would indicate that the game has resumed. For example, the commentator might describe the ball being inbounded, the puck being dropped or the ball being snapped. Alternatively, the commentator may describe the setting as the game is ongoing, with the description of the setting ending with only a small amount of time remaining.

In any event, when the description of the setting ends, there is generally a small amount of time remaining, during which the user of the game must score in order to win the game. At that time the commentator generally describes that the user has the ball or puck and is positioning for a last second score. The message generator simultaneously generates common background noise that takes place during such a sporting event. Such background noise includes general crowd noise, such as cheers, yelling and clapping, along with the crowd's count down of the time remaining and the like.

During this count down, the user must attempt to score a goal before time expires. If time expires, before the user is able to score a goal, i.e. before the sensor 34 senses the ball or puck passing through the opening in the goal 12A, 20A, 22A or 24A, the message generated is the commentator's description of the user's team losing the game. However, if the user scores a goal before time expires, i.e. the sensor 34 senses the ball or puck passing through the opening 12A, 20A, 22A or 24A before time expires, then the message generated is that the user has won the game for his team. The commentator excitedly describes, over the roaring crowd, that the user has scored, that time has expired, that the user's team has won the game, etc.

In short, the audio sports game of the present invention provides a unique way of presenting a setting for a fictional sporting event such that the user has an opportunity to win the sporting event with a last second shot. A message generator 10 is used to create a setting for the user, who must score the all important last shot of the game in order to be a hero and win it for the team. If the user fails to score within the time remaining, the message generator responds with a description of the loss. However, if the user does score, the message generator responds with a jubilant commentator describing the victory over an ecstatic crowd.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A basketball goal apparatus comprising:

(a) a hoop defining an opening therethrough such that an object can pass through said opening;

(b) net means depending from said hoop such that as said object passes through said hoop, said object must pass through said net means;

(c) an audio message generator for selectively generating one of a plurality of user selectable audio messages prior to a user attempting to cause said object to pass through said opening, each of said messages providing a setting for said user by generating a description of a fictional game situation, cheers and a count down, said audio message generator also being capable of generating at least one final message;

(d) a user operable switch for actuating said audio message generator to generate a user selected one of said plurality of messages which provide settings for said user; and (e) a sensor operably associated with said hoop such that said sensor is in a position to sense an object passing through said hoop, said sensor being in communication with said audio message generator such that when one of said messages providing said setting is being generated, and said object is sensed passing through said opening, a signal is transferred from said sensor to said audio message generator for generating said final message and terminating said message providing said setting until another of said messages providing another setting is selected by a user.

2. The apparatus of claim 1 wherein said audio messages have an audio reference to said user of said basketball goal.

3. The apparatus of claim 2 wherein said audio reference to said user is a personal reference to said user by name.

4. The apparatus of claim 1 wherein after said audio message generator is actuated, said audio message generator further provides means for selectively generating one of said at least one final audio messages as a result of said object passing through said hoop and causing said sensor to send a signal to said audio message generator.

5. The apparatus of claim 1 wherein said sensing means is affixed to said hoop.

6. The apparatus of claim 1 wherein said switch means is located at a remote location from said hoop.

7. The apparatus of claim 1 wherein said description of said game situation describes a fictional sports event leading to an opportunity for said user to take the last shot in said fictional sports event.

8. An audio sports game comprising:

(a) an audio message generator having a plurality of user selectable audio messages each of which present a setting for a user of said game, said message generator further having at least one different audio message;

(b) a user operable switch for actuating said audio message generator to generate a user selected one of said plurality of audio messages; and (c) a sensor for attaching to a structure defining an opening therein such that said sensor is in a position to sense an object passing through said opening, said sensor being in communication with said audio message generator such that as said object is sensed passing through said opening, a signal is transferred from said sensor to said audio message generator to stop a selected audio message and generate said different message.

9. The sports game of claim 8 wherein said user selectable and different audio messages have audio reference to said user of said sports game.

10. The sports game of claim 9 wherein said audio reference to said user is a personal reference to said user by name.

11. The sports game of claim 8 wherein said switch is located on said structure.

12. The sports game of claim 8 wherein said switch is located at a remote location from said structure.

13. The audio sports game of claim 8 wherein said selected message presented by said audio message generator includes a countdown of time remaining in a sporting event.

14. The audio sports game of claim 8 wherein said structure defining an opening therein is selected from the group consisting of a soccer goal, a hockey goal, a football goal and a basketball goal.

15. The audio sports game of claim 8 wherein said sensing means is positioned at a remote location from said audio means.

16. The audio sports game of claim 8 wherein said audio sports game further comprises attaching means for removably securing said audio message generator to said structure.

17. The audio sports game of claim 16 wherein said attaching means is a removable strap.

18. The audio sports game of claim 17 wherein said strap has hook and loop fastener strips for facilitating attachment of the audio message generator to said structure.

* * * * *